US007106151B1

(12) United States Patent
Honeycutt et al.

(10) Patent No.: US 7,106,151 B1
(45) Date of Patent: Sep. 12, 2006

(54) RF/MICROWAVE STRIPLINE STRUCTURES AND METHOD FOR FABRICATING SAME

(75) Inventors: Robert M. Honeycutt, Morristown, NJ (US); Joseph P. Mendelsohn, Englishtown, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/122,274

(22) Filed: Jul. 24, 1998

(51) Int. Cl.
*H01P 1/203* (2006.01)

(52) U.S. Cl. ..... 333/204; 333/238

(58) Field of Classification Search ..... 333/204, 333/203, 238, 246
See application file for complete search history.

(56) References Cited

U.S. PATENT DOCUMENTS

| | | | | |
|---|---|---|---|---|
| 2,984,802 | A * | 5/1961 | Dyer et al. | 333/204 |
| 3,863,181 | A * | 1/1975 | Glance et al. | 333/246 X |
| 3,904,997 | A * | 9/1975 | Stinehelfer, Sr. | 333/247 X |
| 4,281,302 | A * | 7/1981 | Stegens | 333/246 X |
| 5,621,366 | A * | 4/1997 | Gu et al. | 333/204 |
| 5,712,607 | A * | 1/1998 | Dittmer et al. | 333/246 X |

FOREIGN PATENT DOCUMENTS

| | | | | |
|---|---|---|---|---|
| DE | 3220789 A1 | * | 12/1984 | 333/246 |
| JP | 62-130001 | * | 6/1987 | 333/246 |
| JP | 2-177702 | * | 7/1990 | 333/238 |

OTHER PUBLICATIONS

Rooney et al., "Printed Circuit Integration of MW Filters", Microwave Journal, vol. 21, No. 9, pp. 68-73, Sep. 1978.*

John D. Rhodes, "The Generalized Interdigital Linear Phase Filter", IEEE Trans. on Microwave Theory & Tech. No. 6, pp. 301-307, Jun. 1970.

George L. Matthaei, "Interdigital Band-Pass Filters", IRE Trans. on Microwave Theory & Tech. pp. 479-491, Nov. 1962.

Levy, "Filters with Single Transmission Zeros . . . Frequencies" IEEE Trans. on Microwave Theory & Tech vol. MTT-24, No. 4, pp. 172-181, Apr. 1976.

* cited by examiner

*Primary Examiner*—Seungsook Ham

(57) ABSTRACT

An improved RF/microwave stripline structure fabricated from a PWB suspended inside of a sheet metal enclosure. The enclosure is formed by top and bottom sheet metal covers each having a plurality of flanges that are coupled to the PWB. The PWB contains identical conductive transmission lines on its top and bottom layers. Plated through holes electrically couple the transmission lines on both layers of the PWB. RF/microwave input and output connectors extend through the bottom cover and are coupled to the transmission lines. Critical dimensions between the transmission lines are controlled by the PWB artwork and are not effected by any misalignment of mechanical parts.

23 Claims, 11 Drawing Sheets

RF/MICROWAVE STRIPLINE STRUCTURES AND METHOD FOR FABRICATING SAME

FIELD OF THE INVENTION

The present invention relates to the field of radio frequency (RF)/microwave stripline structures, and more particularly to an improved RF filter and method for fabricating the same.

BACKGROUND OF THE INVENTION

RF filters are well known in the art and are widely used for controlling and enhancing the performance of communications systems. A variety of conventional RF filters have been designed for such purposes. One common type of conventional RF filter is a stripline filter comprised of a housing and transmission lines housed therein which are both machined from a metal block by milling equipment.

Such conventional RF filters suffer from several drawbacks. First, the machined filter is both heavy and bulky, as well as expensive to manufacture. Second, the formed transmission lines must be relatively thick to resist being bowed during the machining process. This thickness results in high signal loss. Third, machined parts are often mechanically misaligned when formed which can adversely effect both filter performance, as well as the yield of acceptable devices attained from a fabrication run. Fourth, the fabrication process is slow and labor intensive. Finally, the ground planes and fastening and support structures must be relatively thick to support the transmission lines, all of which add to the weight, size and expense of the filter.

To overcome the foregoing drawback associated with transmission lines formed from metal plates, other conventional RF filters use printed wiring boards (PWB) to form the transmission lines. Such filters, however, still use a relatively thick machine formed housing, resulting in a filter which is still relatively heavy, bulky and expensive.

It is therefore an object of the present invention to provide an improved RF filter that is relatively lightweight, small in size and inexpensive to manufacture. Another object of the present invention is to provide an improved RF filter that can be fabricated in an efficient and cost-effective manner resulting in high fabrication yields. It is a further object of the present invention to provide an improved method for fabricating such an RF filter.

SUMMARY OF THE INVENTION

An improved RF/microwave stripline structure and method for fabricating the same, wherein the stripline structure housing is fabricated from formed sheet metal rather than machined metal and the RF/microwave transmission lines are fabricated on a PWB. The use of formed sheet metal reduces the time required to fabricate the filter and results in a filter that is lighter, smaller and less expensive than conventional filters. Use of the PWB eliminates alignment problems because critical dimensions are controlled by the PWB artwork instead of mechanical parts.

DETAILED DESCRIPTION OF THE DRAWINGS

The following detailed description relates to an improved RF filter and a method for fabricating the same. Although the filter housing described herein is fabricated from formed sheet metal, filters fabricated from other types of materials can benefit from the use of the inventive methods and structures described herein and are considered to be within the teachings of the present invention.

Figure 1:
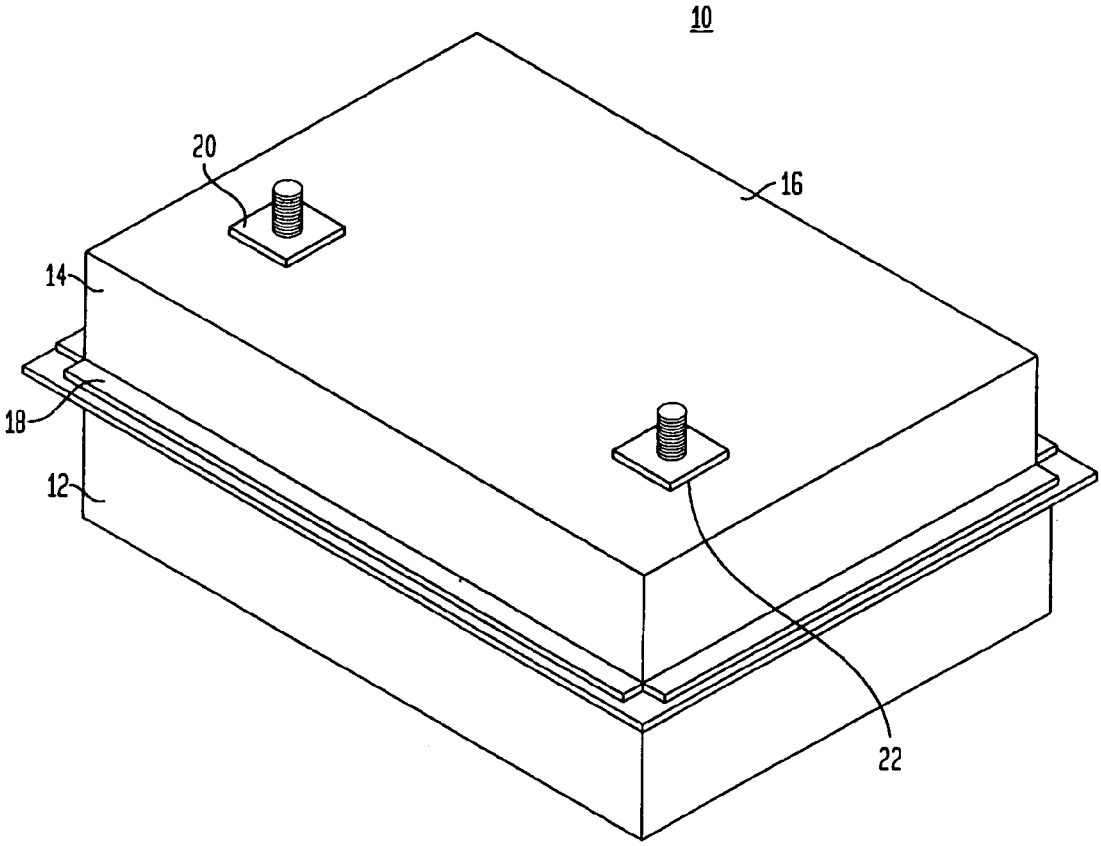
FIG. 1 shows exterior perspective view of an exemplary embodiment of an inverted, improved RF filter according to the present invention.
Figure 2:
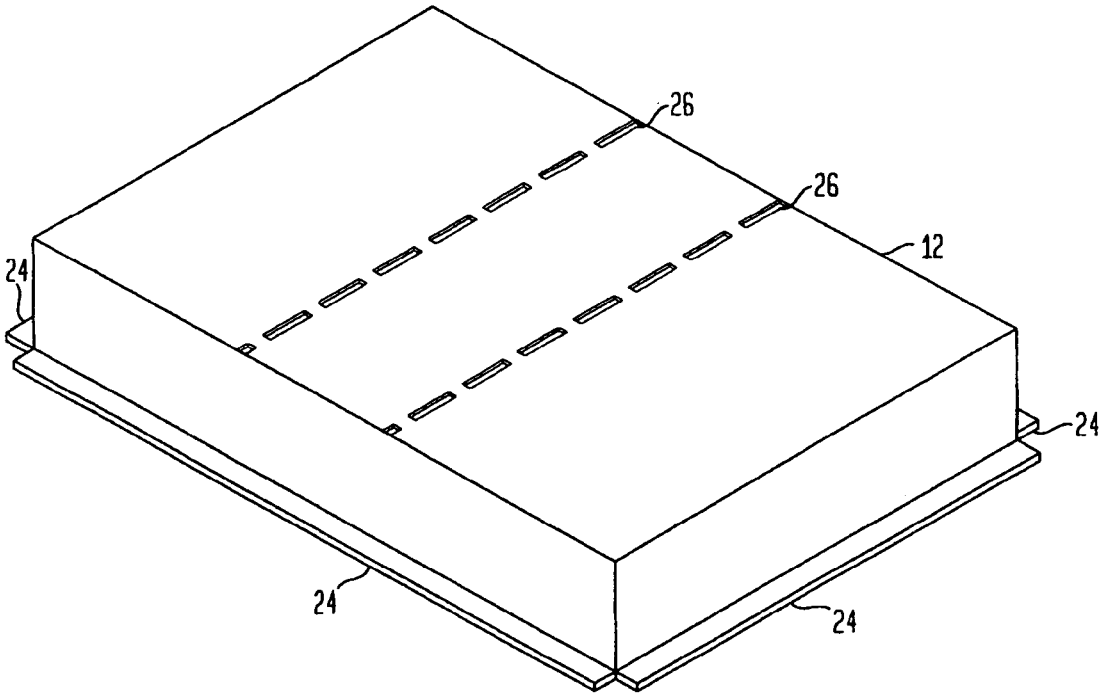
FIG. 2 shows a top view of the exterior of the top cover of the improved RF filter shown in FIG. 1.
Figure 3:
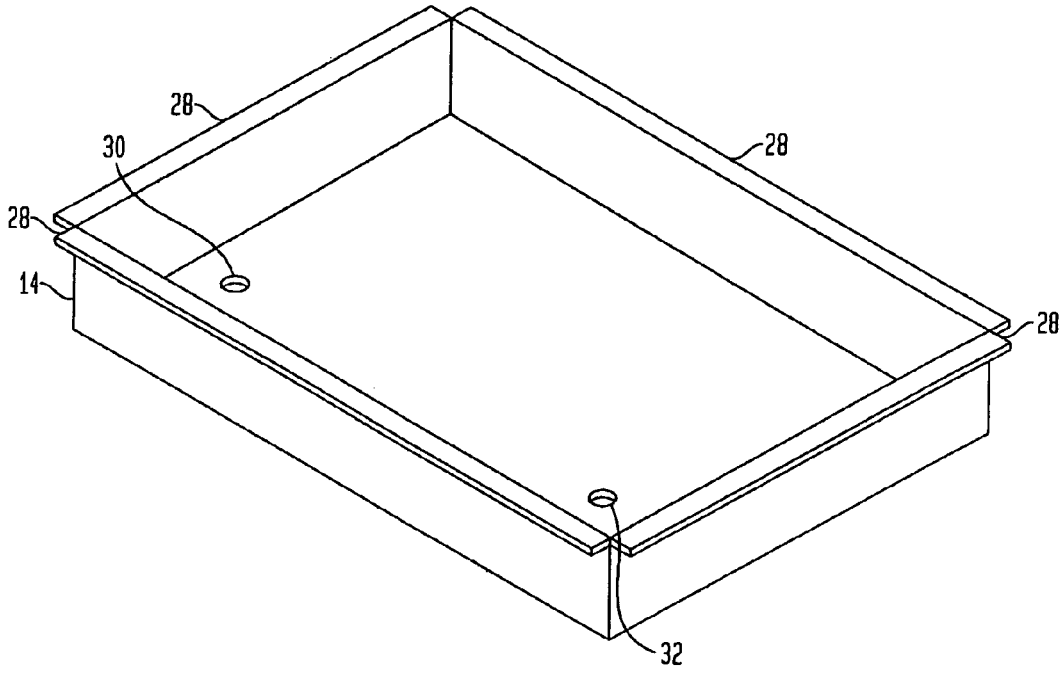
FIG. 3 shows a top view of the interior of the bottom cover of the improved RF filter shown in FIG. 1.

FIG. 1 shows an exterior perspective view of an exemplary embodiment of an inverted, improved RF filter 10 according to the present invention. Filter 10 includes top cover 12 and bottom cover 14 which together define a cavity 16 in which the filter components are housed. FIG. 2 shows a top view of the exterior of top cover 12, and FIG. 3 shows a top view of the interior of bottom cover 14.

Top cover 12 and bottom cover 14 are fabricated from sheets of metal formed into any desired shape by bending, drawing, etching and forming, or stamping. As shown in FIG. 2, top cover 12 includes four protruding flanges 24 formed by outwardly folding the sheet metal sides of the top cover 12. Similarly, as shown in FIG. 3, bottom cover 14 includes four likewise formed flanges 28 protruding outwardly from bottom cover 14. Top cover 12 and bottom cover 14 may be plated, for example with silver, to decrease the signal loss of filter 10, as well as to increase the resistance of filter 10 to environmental and/or electromagnetic effects.

Figure 4:
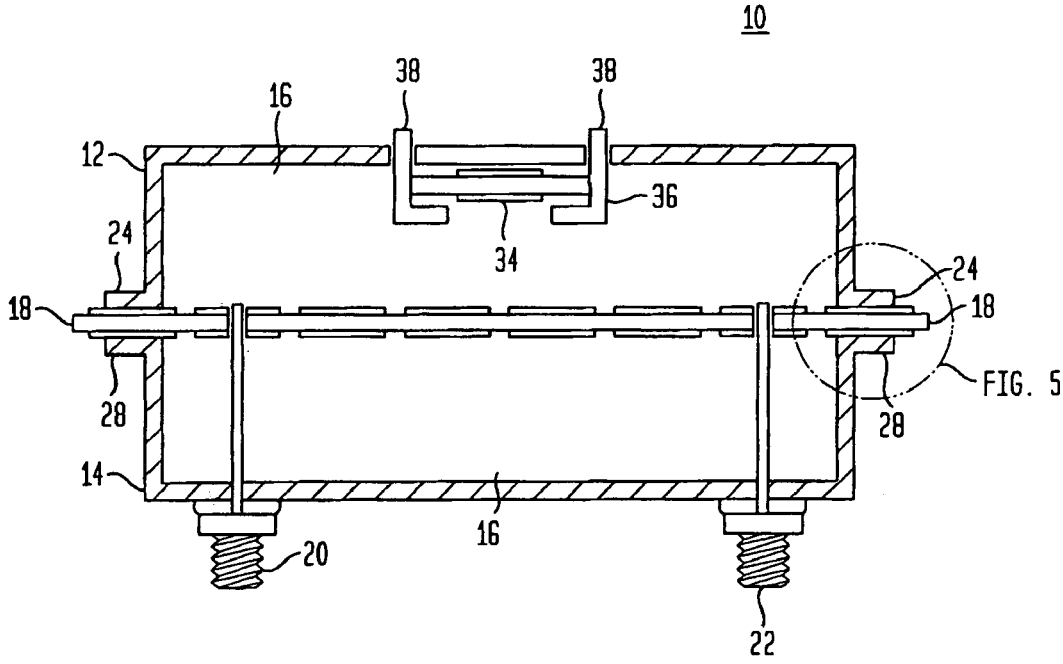
FIG. 4 shows a cross sectional view of the improved RF filter shown in FIG. 1.
Figure 5:
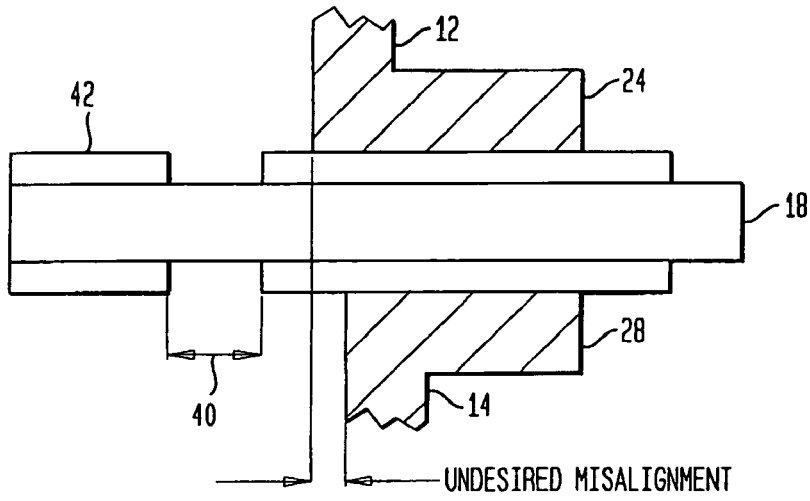
FIG. 5 shows a detailed section of the improved RF filter shown in FIG. 4.

FIG. 4 shows a cross-sectional view of filter 10. Filter 10 includes a conventional PWB 18 which is horizontally positioned across the cavity 16 between the top cover flanges 24 and the bottom cover flanges 28. PWB 18 extends outwards past the edges of top cover and bottom cover flanges 24 and 28. The PWB 18 is coupled to the flanges 24 and 28 by a conventional fastener, such as rivets, or is alternatively bonded to the flanges 24 and 28 by epoxy, solder, welding, or a combination of the same. FIG. 5 shows an enlarged view of detail A—A of FIG. 4. It should be understood that the improved RF filter housed in the enclosure formed by top and bottom covers 12 and 14 according to the present invention need not be fabricated using a PWB. The PWB can be replaced by either sheet metal or machined metal onto which the circuit is formed. However, using sheet metal or machined metal in lieu of a PWB will negate the tolerance control benefits derived from using a PWB.

In an alternative embodiment of filter 10 not shown, the top and bottom covers 12 and 14 can be fabricated without folding the sheet metal into the protruding flanges 24 and 28. Rather, the top and bottom covers 12 and 14 can be coupled to the PWB 18 by means of alignment pegs that are partially inserted through the PWB 18. This is how sheet metal shields, such as the enclosure formed by top and bottom covers 12 and 14, are typically installed on a PWB.

Figure 6:
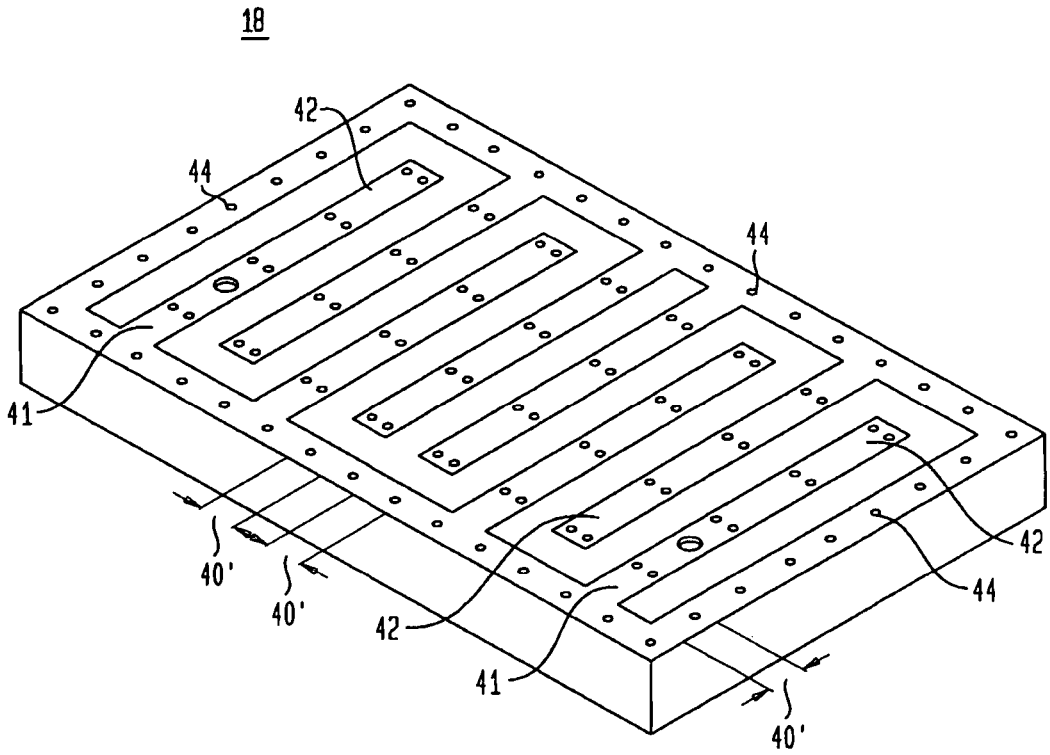
FIG. 6 shows a primary PWB for a cross coupled filter in accordance with the exemplary embodiment of the improved RF filter shown in FIG. 1.
Figure 7:
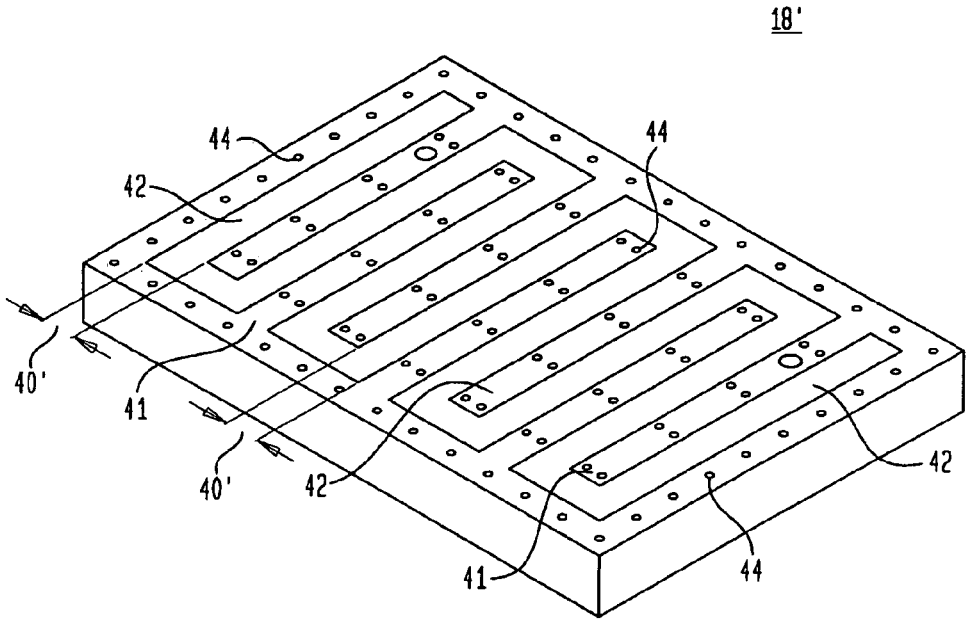
FIG. 7 shows a primary PWB for a non-cross coupled filter in accordance with the exemplary embodiment of the improved RF filter shown in FIG. 1.

FIG. 6 shows a PWB 18 used for a cross coupled filter, and FIG. 7 shows a PWB 18' used for a non-cross coupled filter. Transmission lines 42 of conductive material are formed on both PWB 18 and PWB 18' using conventional fabrication techniques such as photolithography, etc. PWB 18 has a top layer and a bottom layer and has an identical artwork pattern formed on both its top and bottom layers. Similarly, PWB 18' also has a top layer and a bottom layer and has an identical non-cross coupled artwork pattern, formed on both its top and bottom layers. A series of plated through holes 44 enable the artwork patterns on both layers of the PWBs 18 and 18', respectively, to be electrically coupled. PWBs 18 and 18' can alternatively be fabricated to have more than two layers. Also, the artwork of the cross coupled and non-cross coupled circuits does not have to be formed on both layers of the PWBs 18 and 18', respectively. However, doing so reduces the signal loss of filter 10.

As shown in FIGS. 1 and 4, bottom cover 14 includes a pair of RF connectors 20 and 22 which protrude through holes 30 and 32 shown in FIG. 3. The RF connectors 20 and 22 are soldered to the PWB 18 at two of the plated through holes 44, and are bonded to the bottom cover 14 using epoxy, solder or welding. Alternatively, the RF connectors 20 and 22 can be coupled to the PWB 18 and the bottom cover 14 by means surface mount or through hole connectors mounted directly on the PWB 18. In addition, the RF connectors 20 and 22 can be coupled through any side of filter 10.

As shown in FIGS. 5, 6 and 7, filter 10 includes critical gaps 40 formed between rods 41 on the PWB 18, which gaps 40 act as capacitances for controlling the filter 10. Conventional filters having transmission lines fabricated from machined elements sometimes have difficulty achieving and maintaining critical tolerances, such as the dimensions of the critical gap 40, due to the bowing and misalignment of mechanically formed parts.

By employing the fabrication method of the present invention, critical tolerances such as the dimensions of the critical gap 40 can be easily controlled by the PWB artwork, instead of being dependent upon the correct alignment of mechanical parts. Consequently, this permits the sheet metal components of filter 10 to have larger tolerances such that any misalignment of filter components, as is shown for example in FIG. 5, will not adversely effect the performance of filter 10.

The present invention provides a simplified method for fabricating a non-cross coupled RF filter. First, the top and bottom covers 12 and 14 are formed from sheet metal. Then, PWB 18 is placed on the bottom cover flanges 28 and held in place while the RF connectors 20 and 22 are inserted through holes 30 and 32 and bonded to the bottom cover 14 and soldered to the through holes 44 of PWB 18. The top cover 12 is then placed over the PWB 18 and top cover flanges 24 and bottom cover flanges 28 are coupled to the PWB 18 and to each other by epoxy, solder, or welds.

Figure 8:
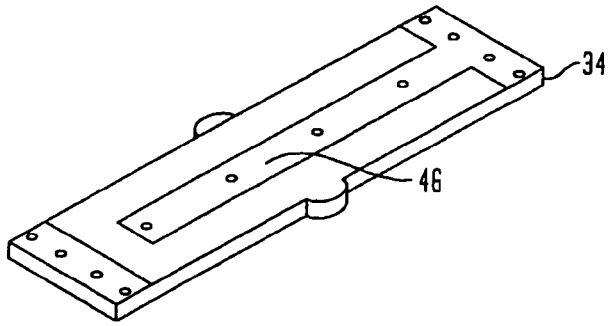
FIG. 8 shows a secondary PWB for a cross coupled filter in accordance with the exemplary embodiment of the improved RF filter shown in FIG. 1.
Figure 9:
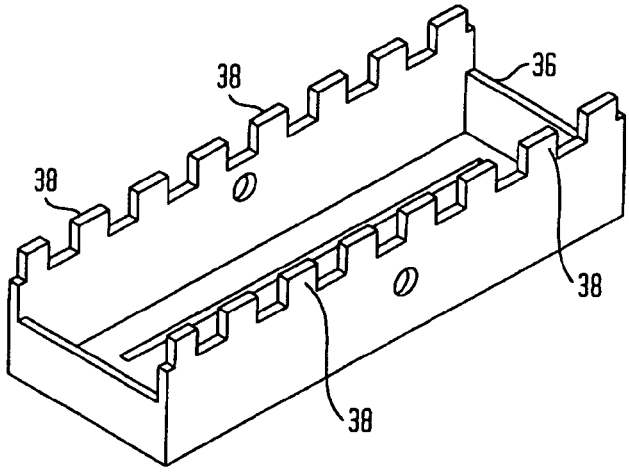
FIG. 9 shows a secondary PWB mount for the secondary PWB shown in FIG. 8.

The present invention also provides a simplified method for fabricating a cross coupled RF filter in which a secondary PWB 34, shown in FIG. 8, and having a single transmission line 42 is positioned apart from and parallel to the primary PWB 18' in the enclosure formed by top cover 12 and bottom cover 14. Specifically, secondary PWB 34 is coupled by means of solder or epoxy to a secondary PWB mount 36 shown in FIG. 9 to form an assembly which is coupled to the interior of the top cover 12. The secondary PWB 34 is used for ease of fabricating the cross coupled RF filter. The circuitry formed on secondary PWB 34 can alternatively be formed on sheet metal or machined metal. However, using sheet metal or machined metal in lieu of a PWB will negate the tolerance control benefits derived from using a PWB.

Figure 10:
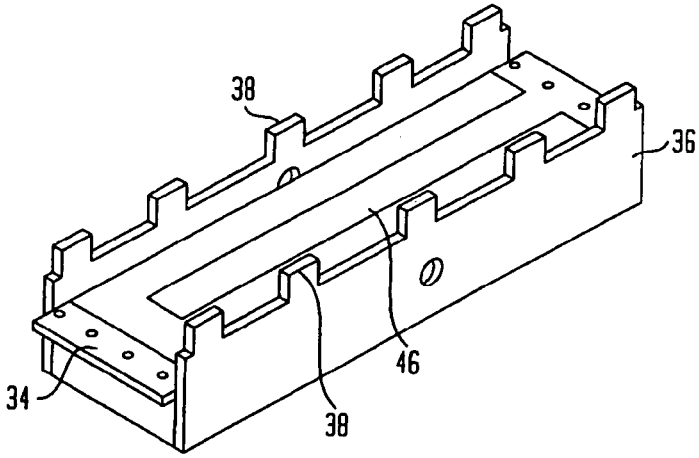
FIG. 10 shows the secondary PWB shown in FIG. 8 mounted in the secondary PWB mount shown in FIG. 9.

Secondary PWB mount 36 is fabricated from sheet metal in the same manner as the top and bottom covers 12 and 14, and includes a plurality of flanges 38 configured for insertion into openings 26 formed in top cover 12 and shown in FIG. 2. The assembly of secondary PWB 34 and secondary PWB mount 36, shown in FIG. 10, is coupled to the interior of the top cover 12 by inserting the flanges 38 into the openings 26. The flanges 38 are then grounded together using epoxy, rivets, solder or welds. The secondary PWB 34 and secondary PWB mount 36 are not included in non-cross coupled filters, nor does top cover 12 need to include openings 26 for such filters.

Figure 11:
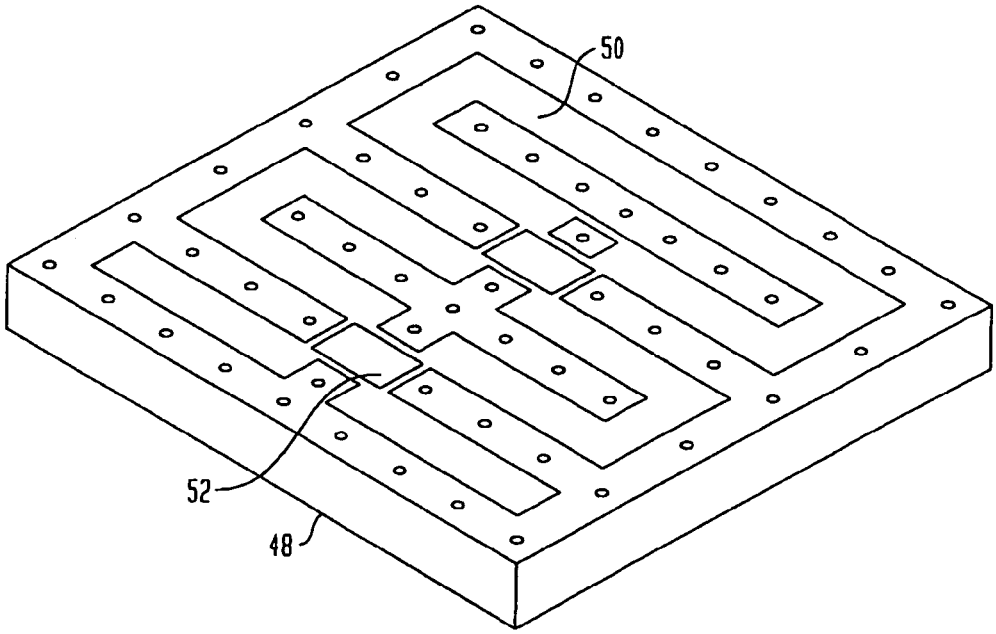
FIG. 11 shows the top layer of a third PWB for an alternative exemplary embodiment of an improved RF filter according to the present invention.
Figure 12:
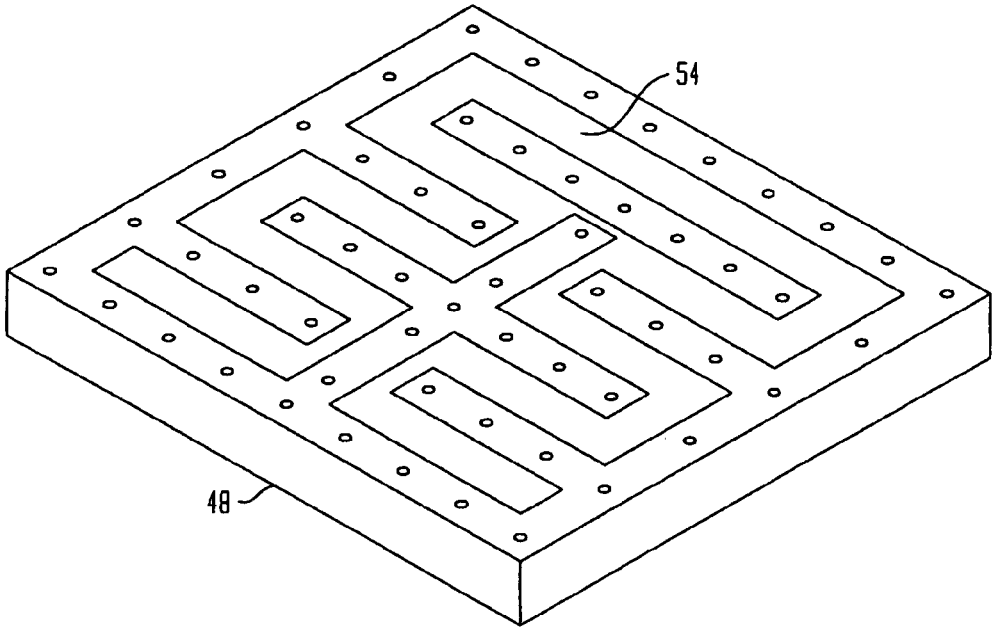
FIG. 12 shows the bottom layer of the third PWB shown in FIG. 11.
Figure 13:
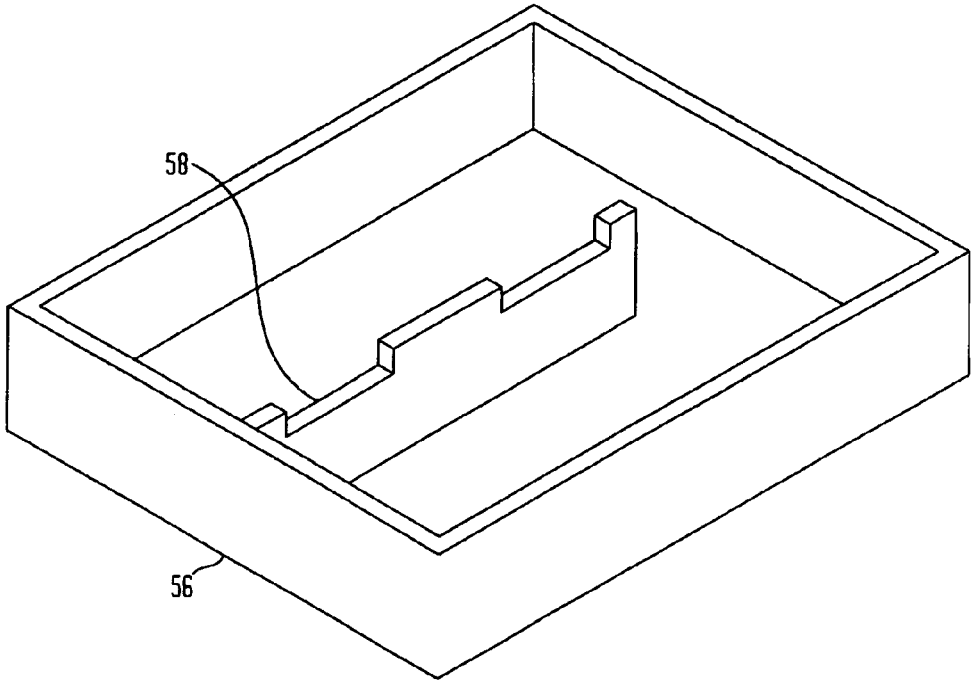
FIG. 13 shows the top cover for an enclosure housing the PWB shown in FIGS. 11 and 12.
Figure 14:
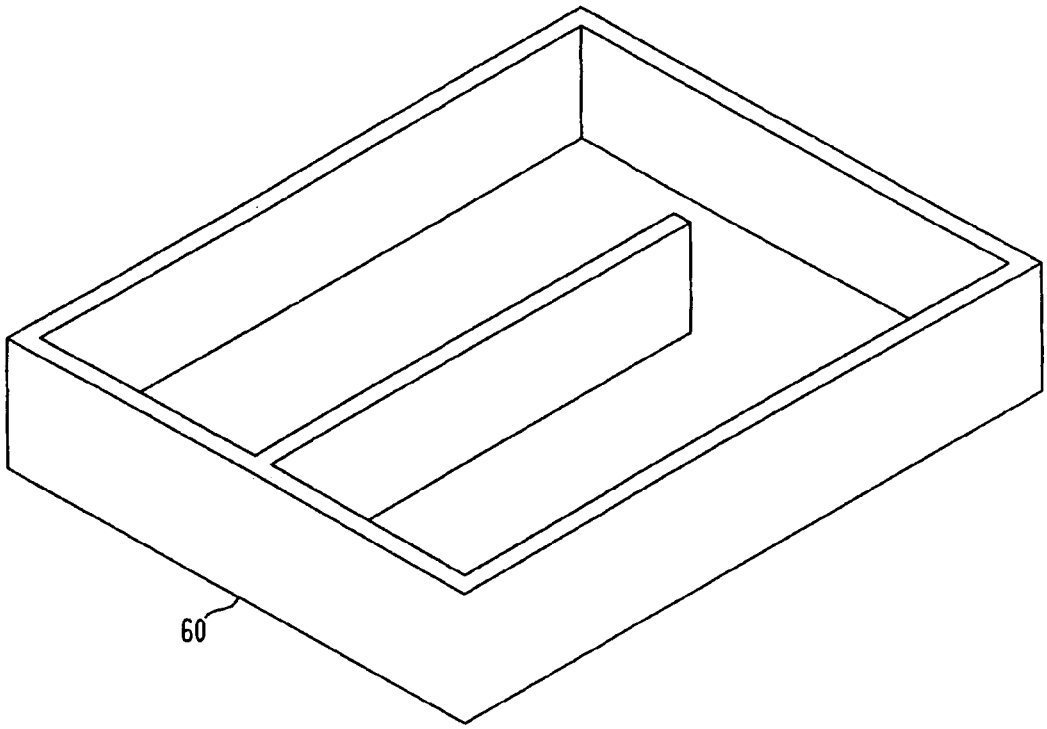
FIG. 14 shows the bottom cover for an enclosure housing the PWB shown in FIGS. 11 and 12.

In an alternative embodiment of the present invention not shown, a cross coupled filter can be fabricated by modifying the artwork formed on PWB 18' to include cross coupling elements. In another alternative embodiment of the present invention, a cross coupled filter can be fabricated using a single PWB 48 having a top layer 50 and a bottom layer 54, shown in FIGS. 11 and 12, respectively, which is housed in an enclosure formed by top cover 56 and bottom cover 60, shown in FIGS. 13 and 14, respectively. The cross coupling elements are printed on PWB 48, with the artwork pattern formed on top layer 50 being different from that formed on bottom layer 54. Cross coupling is achieved by routing element 52 shown in FIG. 11 through small openings 58 shown in FIG. 13 and then coupling to the cross coupling point via artwork, discrete components or wiring. In yet another alternative embodiment not shown, a cross coupled filter can be fabricated using a multi-layer PWB by using the routing on the inner layers of the PWB. All three of the alternative embodiments of a cross coupled filter just described eliminate the need for a secondary PWB. It should also be noted that since it is the artwork formed on a PWB that determines the circuit's operational capabilities, cross coupling can be achieved by PWBs having either identical or differing artwork on its respective layers.

Figure 15:
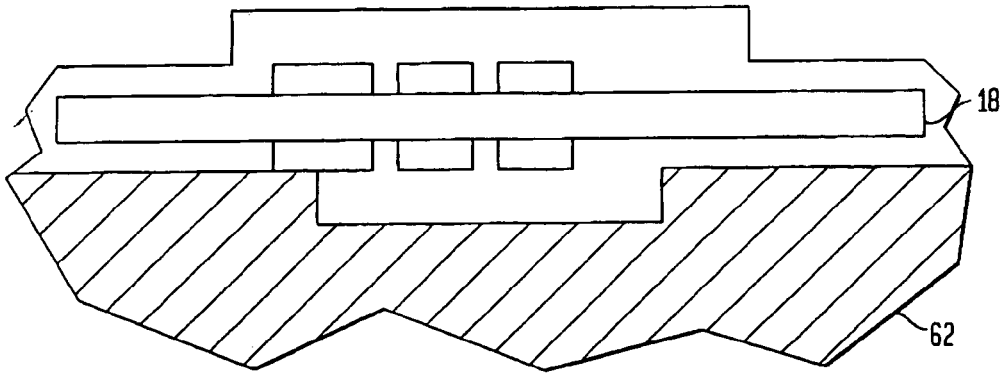
FIG. 15 shows an alternative embodiment of an improved RF filter according to the present invention in which the filter is mounted onto a chassis and only includes a top sheet metal cover.

FIG. 15 shows still another alternative embodiment of the RF filter 10 of the present invention in which PWB 18 rests on a chassis 62, such as a heat sink, enclosed only by top cover 12. This embodiment of filter 10 need not include a bottom cover since the chassis serves to protect and thus maintain the structural integrity of the filter 10 in the same manner as would a bottom cover.

The RF filter of the present invention provides a lightweight, small size and inexpensive filter having many applications. The filter can be used for commercial or military applications, and can be used for high power, e.g. 1 kW, or low power, e.g. 1 pW, applications. The filter can also operate over a broad frequency range, e.g. from 100 MHz to approximately 50 GHz. The filter can also be used with multiple port structures such as diplexors, n-way combiners or splitters, and hybrid combiners and splitters. The filter can also be a delay line operating, for example, in a combline or interdigital filter and having a 2 millisecond delay at 2 GHz. The delay line can be implemented with or without cross coupling.

Numerous modifications to and alternative embodiments of the present invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all the modifications which come within the scope of the appended claims is reserved.

What is claimed is:

1. An improved stripline structure, comprising:

a sheet metal enclosure including top and bottom sheet metal covers for housing a stripline structure;

a primary printed wiring board (PWB) disposed horizontally between the top and bottom sheet metal covers, and extending across the interior of the enclosure, the primary PWB including a plurality of conductive transmission lines wherein the primary PWB has a top layer and a bottom layer, the conductive transmission lines being formed on both the top layer and the bottom layer, and wherein the primary PWB includes a series of plated through holes for electrically coupling the conductive transmission lines formed on both sides of the primary PWB; and a pair of RF/microwave connectors electrically coupled to the primary PWB and to the bottom sheet metal cover via a pair of plated through holes of said series.

2. The improved stripline structure according to claim 1, wherein the top and bottom sheet metal covers each include a plurality of flanges extending outwardly from the enclosure, the primary PWB extending outside of the enclosure and being coupled to both the top and bottom sheet metal cover flanges.

3. The improved stripline structure according to claim 1, wherein the sheet metal enclosure is box-shaped.

4. The improved stripline structure according to claim 3, wherein the sheet metal is folded by a stamping process.

5. The improved stripline structure according to claim 1, wherein the top and bottom sheet metal covers are each coupled to ground.

6. The improved stripline structure according to claim 1, further comprising a secondary PWB mounted inside the enclosure, the secondary PWB having at least one conductive transmission line formed apart from and parallel to the conductive transmission lines on the primary PWB.

7. The improved stripline structure according to claim 6, further including a secondary PWB mount fabricated from sheet metal for coupling the secondary PWB to the interior of the top cover.

8. The improved stripline structure according to claim 7, wherein the secondary PWB provides cross-coupling between the conductive transmission line on the secondary PWB and selected ones of the conductive transmission lines on the primary PWB.

9. The improved stripline structure according to claim 7, wherein the improved stripline structure is an RF filter.

10. The improved stripline structure according to claim 1, wherein the conductive transmission lines formed on the top layer being different from the conductive transmission lines formed on the bottom layer.

11. The improved stripline structure according to claim 10, wherein the improved stripline structure is a cross coupled RF filter.

12. The improved stripline structure according to claim 11, wherein the cross coupled RF filter is configured for operating at high power up to 1 kW.

13. The improved stripline structure according to claim 11, wherein the cross coupled RF filter is configured for operating at large bandwidths up to 50 GHz.

14. An improved cross coupled radio frequency (RF) filter comprising:

a sheet metal enclosure including top and bottom sheet metal covers for housing a cross coupled RF filter, each one of the top and bottom covers having a plurality of flanges extending outwardly therefrom;

a primary printed wiring board (PWB) having a top layer and a bottom layer, the primary PWB being horizontally disposed between the top and bottom covers and extending across the interior of the enclosure, the primary PWB being coupled to the plurality of top and bottom cover flanges, and the primary PWB having a plurality of conductive RF transmission lines, wherein the plurality of conductive RF transmission lines are formed on both sides of the primary PWB, and wherein the primary PWB includes a series of plated through holes for electrically coupling the conductive RF transmission lines on both sides of the primary PWB;

a pair of RF/microwave connectors electrically coupled to the primary PWB and to the bottom sheet metal cover via a pair of plated through holes of said series; and a secondary PWB mounted inside the enclosure, the secondary PWB having at least one conductive RF transmission line spaced apart from and parallel to the conductive RF transmission lines on the primary PWB.

15. The improved cross coupled RF filter according to claim 14, further comprising a secondary PWB mount fabricated from sheet metal for coupling the secondary PWB to the interior of the top cover.

16. The improved cross coupled RF filter according to claim 15, wherein the secondary PWB provides cross-coupling with selected ones of the conductive RF transmission lines on the primary PWB.

17. The improved cross coupled RF filter according to claim 14, wherein the sheet metal enclosure is box-shaped.

18. The improved cross coupled RF filter according to claim 14, wherein the improved cross coupled RF filter is configured for operating at high power up to 1 kW.

19. The improved cross coupled RF filter according to claim 14, wherein the improved cross coupled RF filter is configured for operating at large bandwidths up to 50 GHz.

20. A method for fabricating an improved RF/microwave stripline structure, comprising the steps of:

folding a pair of sheet metal members into top and bottom covers;

positioning a primary printed wiring board (PWB) having conductive transmission lines between the top and bottom covers while coupling a pair of RF/microwave connectors to the primary PWB through the bottom cover; and coupling the top and bottom covers to the primary PWB.

21. The method according to claim 20, further comprising the step of coupling a secondary PWB to the interior surface of the top cover before coupling the top and bottom covers to the primary PWB, wherein the primary and secondary PWB form a cross coupled stripline structure.

22. A method for fabricating an improved radio frequency filter, comprising the steps of:

folding a pair of sheet metal members into top and bottom filter covers, the top and bottom filter covers each having a plurality of flanges extending outwards therefrom;

positioning a primary printed wiring board (PWB) having conductive RF transmission lines onto the plurality of flanges of the bottom filter cover while coupling a pair of RF connectors to both the primary PWB through the bottom cover; and coupling the top and bottom covers to the primary PWB by securing the plurality of top cover flanges to the top of the primary PWB and securing the plurality of bottom cover flanges to the bottom of the primary PWB.

23. The method according to claim 22, further comprising the step of coupling a secondary PWB to the interior surface of the top cover before coupling the top and bottom covers to the primary PWB, wherein the primary and secondary PWB form a cross-coupled radio frequency filter.

* * * * *